US008079237B2

(12) United States Patent
Yang et al.

(10) Patent No.: US 8,079,237 B2
(45) Date of Patent: Dec. 20, 2011

(54) LOCKING ASSEMBLY FOR ELECTRONIC DEVICE

(75) Inventors: Xin Yang, Shenzhen (CN); Wei Wu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 360 days.

(21) Appl. No.: 12/422,299

(22) Filed: Apr. 13, 2009

(65) Prior Publication Data

US 2010/0154493 A1 Jun. 24, 2010

(30) Foreign Application Priority Data

Dec. 22, 2008 (CN) ..... 2008 1 0306443

(51) Int. Cl.
*E05B 69/00* (2006.01)

(52) U.S. Cl. ..... 70/58; 70/14; 70/277; 70/279.1; 361/679.57

(58) Field of Classification Search ..... 70/14, 57.1, 70/58, 34, 276, 277, 278.1, 279.1, 280; 361/679.57
See application file for complete search history.

(56) References Cited

U.S. PATENT DOCUMENTS 4,236,395 A * 12/1980 Avaiusini ..... 70/34
5,611,223 A * 3/1997 Spitzer ..... 70/58
5,697,233 A * 12/1997 Albert et al. ..... 70/58
5,987,937 A * 11/1999 Lee ..... 70/14
6,088,229 A * 7/2000 Seto et al. ..... 361/726
6,425,272 B1 * 7/2002 Chen ..... 70/34
6,457,336 B1 * 10/2002 Bremicker ..... 70/34
6,575,000 B1 * 6/2003 Li ..... 70/34
6,854,302 B2 * 2/2005 Zapushek et al. ..... 70/34
6,867,685 B1 * 3/2005 Stillwagon ..... 340/5.64
7,684,188 B2 * 3/2010 Tzeng et al. ..... 361/679.57
7,698,916 B2 * 4/2010 Davis ..... 70/34
7,775,071 B2 * 8/2010 Agbay ..... 70/34
7,836,551 B2 * 11/2010 Hung et al. ..... 16/319
7,870,765 B2 * 1/2011 Shatskin ..... 70/34
7,948,751 B2 * 5/2011 Escamilla et al. ..... 361/679.57
2005/0262904 A1 * 12/2005 Ling et al. ..... 70/49
2007/0074547 A1 * 4/2007 Wu ..... 70/58
2007/0137266 A1 * 6/2007 Hsai ..... 70/34
2007/0144225 A1 * 6/2007 Tamura ..... 70/58
2008/0223090 A1 * 9/2008 Liao ..... 70/58
2009/0189765 A1 * 7/2009 Lev et al. ..... 340/568.2
2009/0235699 A1 * 9/2009 Hsiao et al. ..... 70/58
2010/0071423 A1 * 3/2010 Dehaan et al. ..... 70/58
2010/0147041 A1 * 6/2010 Teicher et al. ..... 70/58
2010/0192642 A1 * 8/2010 Hung et al. ..... 70/58
2010/0300158 A1 * 12/2010 Andres et al. ..... 70/58

* cited by examiner

*Primary Examiner* — Suzanne Barrett
(74) *Attorney, Agent, or Firm* — Altis Law Group, Inc.

(57) ABSTRACT

A locking assembly for an electronic device includes a first lock-member and a second lock-member. The first lock-member includes a rotatable locking head. The locking head includes a lock lever, a locking block and an adjusting portion. The locking block and the adjusting portion are fixed at two opposite ends of the lock lever. The second lock-member is fixed to the electronic device and includes a lock core and a guiding block extending from the lock core. The lock core defines a locking groove. The guiding block is rotated together with the lock core between a first position where a longitudinal direction of the locking groove crosses that of the locking block and a second position where the longitudinal direction of the locking groove is approximately parallel to that of the locking block.

12 Claims, 9 Drawing Sheets

LOCKING ASSEMBLY FOR ELECTRONIC DEVICE

BACKGROUND

1. Technical Field

The present disclosure relates to locks, and particularly, to a locking assembly for an electronic device.

2. Description of Related Art

Compact electronic devices, such as laptops are popular with people due to their portability. However, because of their portability, these laptops can easily be stolen when not guarded or secured.

Therefore, what is needed is to provide a locking assembly for an electronic device, in which the above problem is eliminated or at least alleviated.

DETAILED DESCRIPTION

Figure 1:
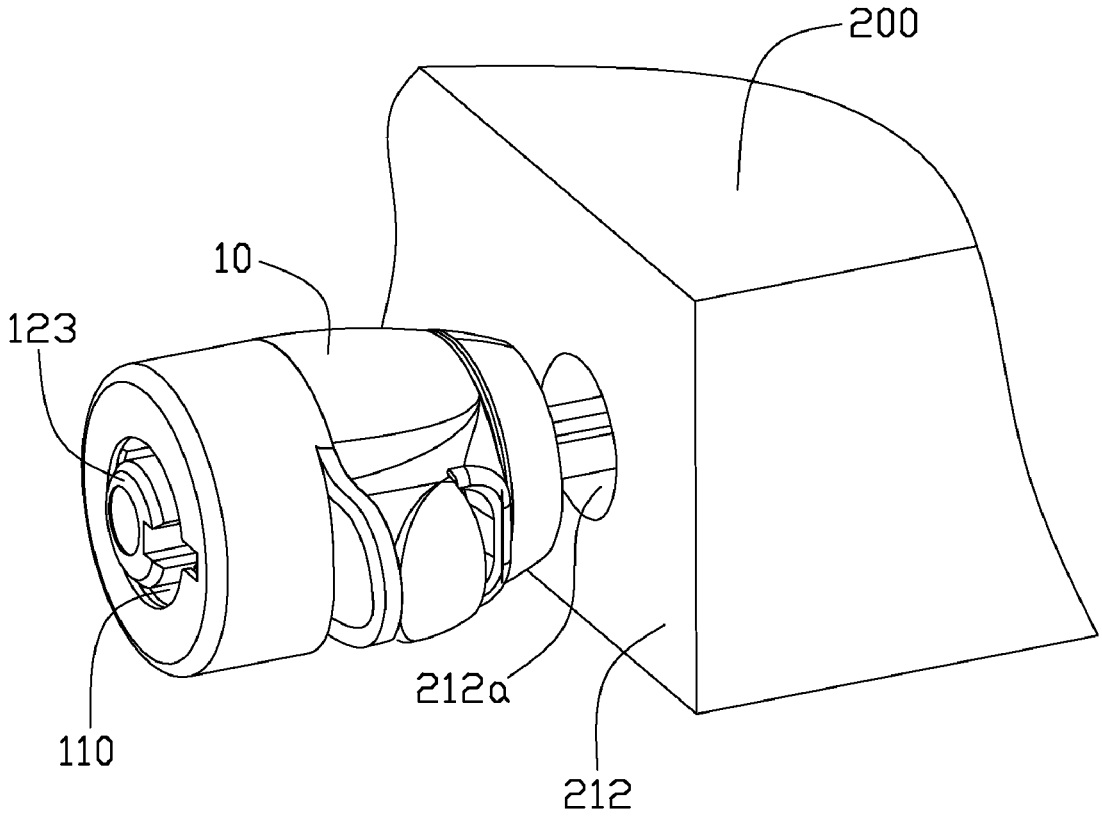
FIG. 1 is a partially schematic isometric view of a locking assembly for an electronic device, according to an exemplary embodiment.
Figure 2:
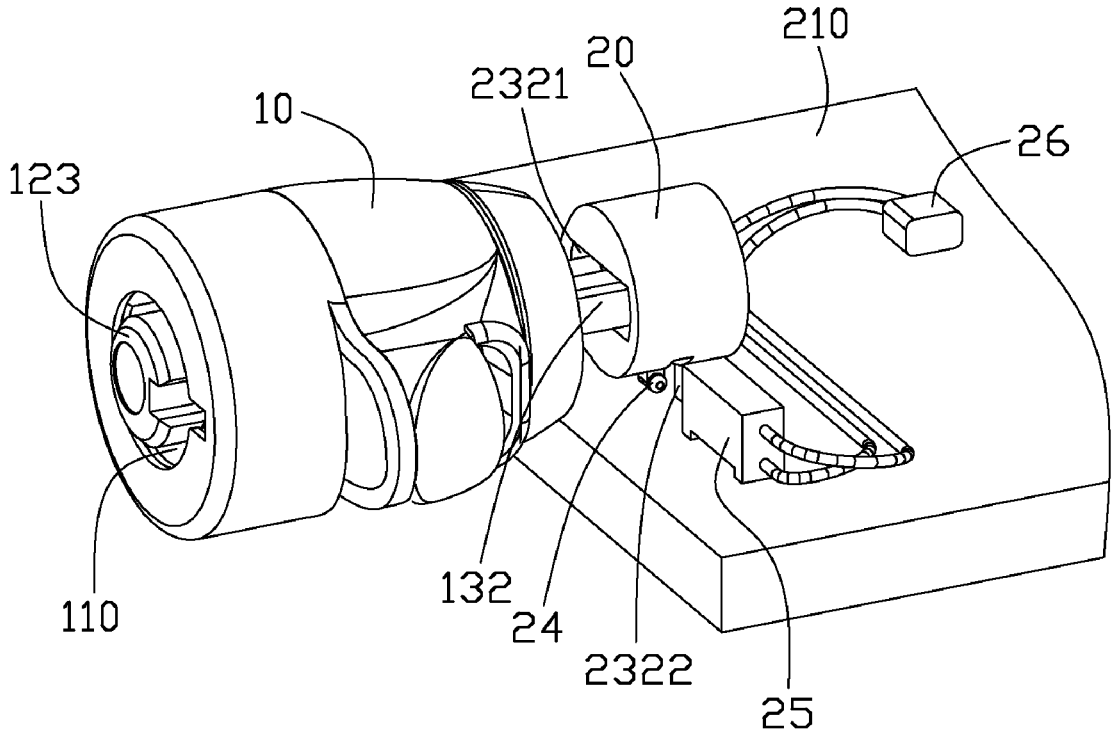
FIG. 2 is a schematic isometric view of the locking assembly including a first lock-member and a second lock-member of FIG. 1, showing the first lock-member locked by the second lock-member.
Figure 3:
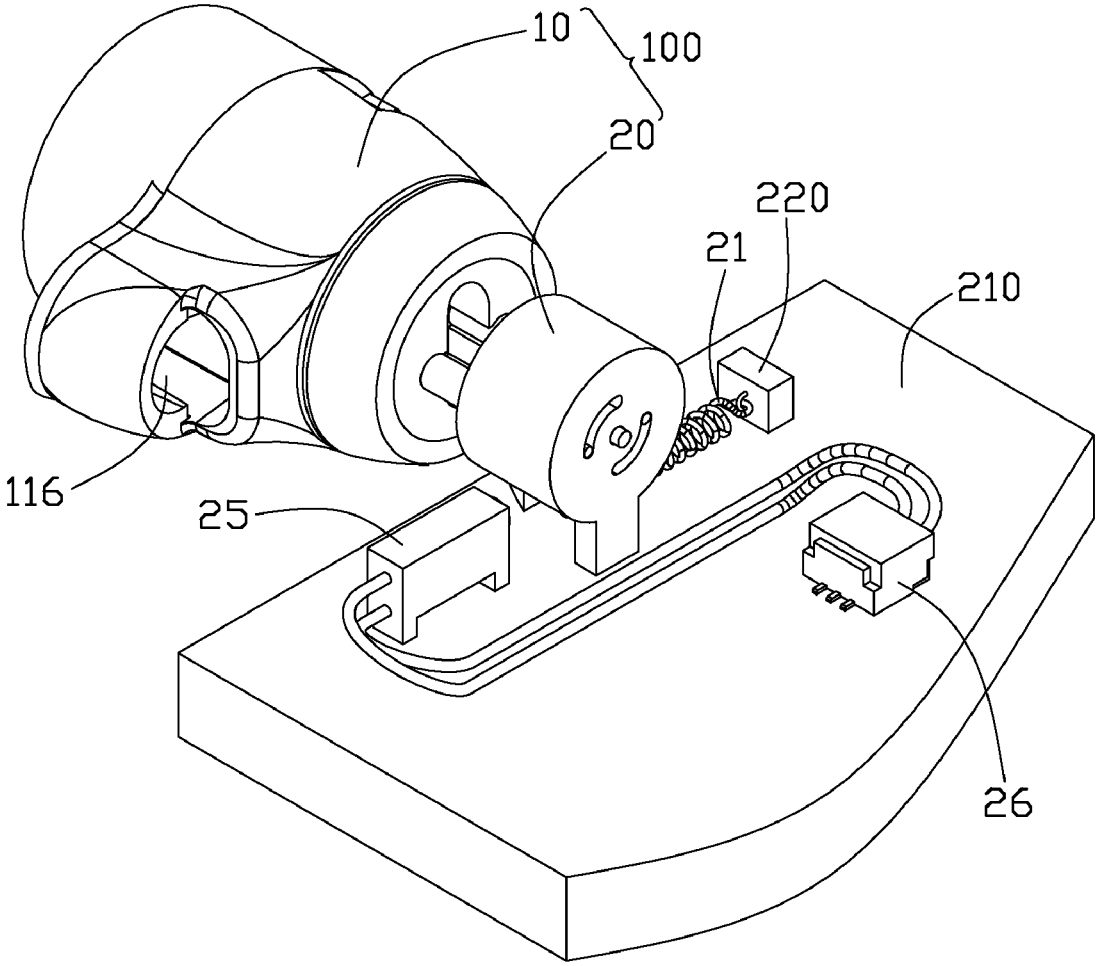
FIG. 3 is similar to FIG. 2, but viewing the lock assembly from another angle.

Referring to FIGS. 1-3, a lock assembly 100 for an electronic device 200 includes a first lock-member 10 and a second lock-member 20. The second lock-member 20 is fixed inside the electronic device 200. For example, the electronic device 200 may include a fixed sheet 210 inside the electronic device 200, and the second lock-member 20 is received in the electronic device 200 and is fixed on the fixed sheet 210. The electronic device 200 further includes a side surface 212. An insertion through hole 212*a* is defined through the side surface 212 of the electronic device 200.

Figure 4:
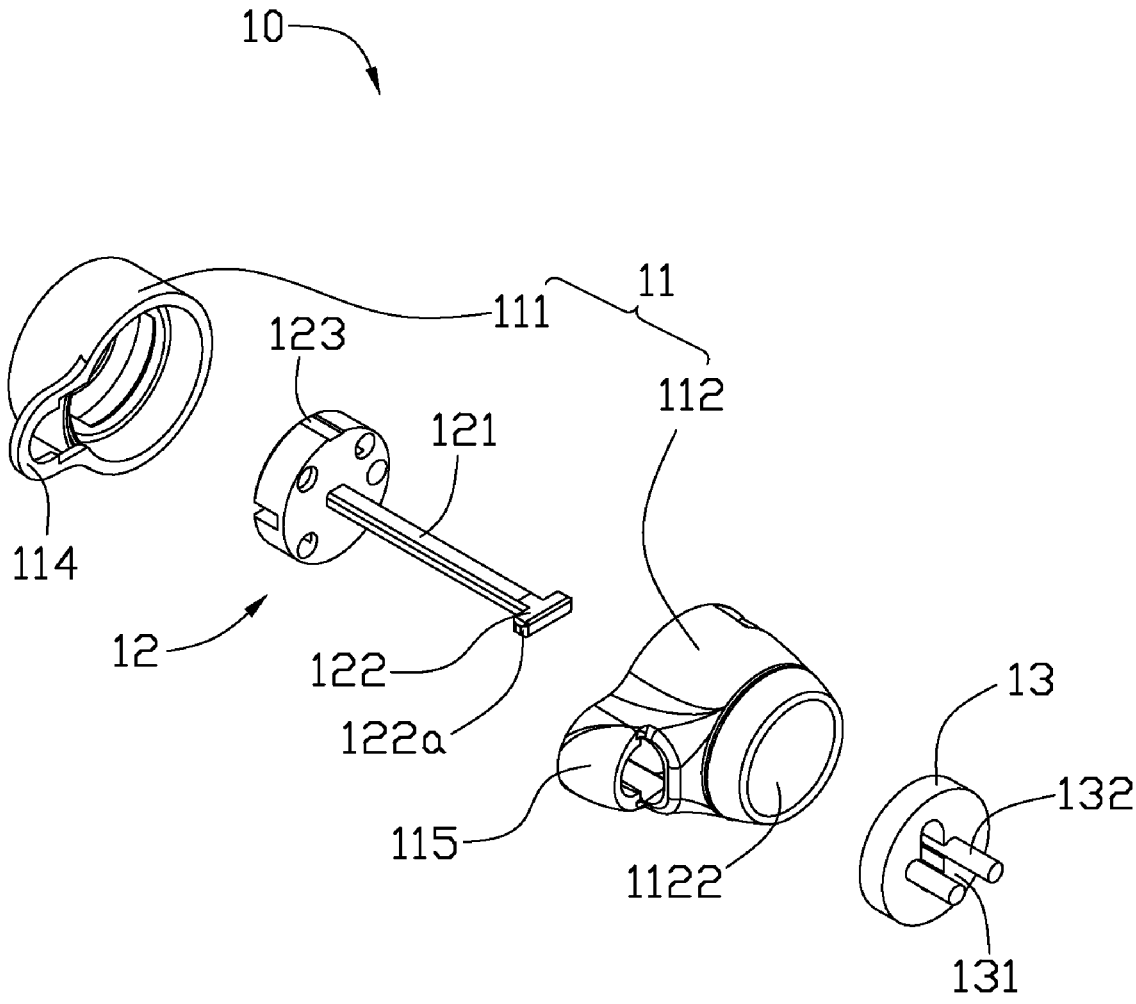
FIG. 4 is a schematic isometric disassembled view of the first lock-member of FIG. 2.
Figure 5:
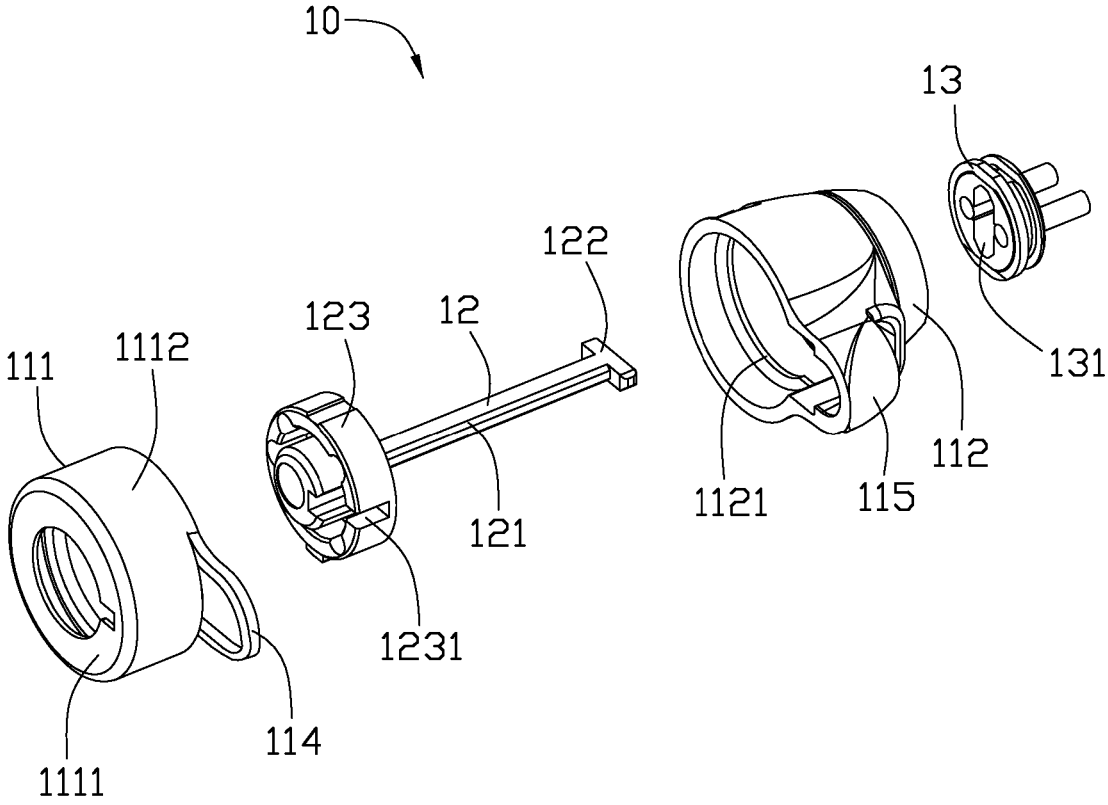
FIG. 5 is similar to FIG. 4, but viewing the first lock-member from another angle.

Referring to FIGS. 4 and 5 together with FIGS. 2 and 3, the first lock-member 10 is substantially cylindrical and includes a first cylindrical case 11, a locking head 12, and a lid 13. The first cylindrical case 11 includes a front hollow cylinder 111 and a rear hollow cylinder 112. The front hollow cylinder 111 and the rear hollow cylinder 112 cooperatively define a keyway 110. The front hollow cylinder 111 includes an inner flange 1111 extending from an end of the front hollow cylinder 111. A first ring portion 114 is formed on an outer surface of the front hollow cylinder 111 adjacent to another end of the front hollow cylinder 111. The another end of the front hollow cylinder 111 is opposite to the end of the front hollow cylinder 111 where the inner flange 1111 extends therefrom. The rear hollow cylinder 112 includes a second ring portion 115 formed on an outer surface thereof, corresponding to the first ring portion 114 of the front hollow cylinder 111. An inner circular stopper portion 1121 is formed on an inner surface of the rear hollow cylinder 112. The first ring portion 114 and the second ring portion 115 cooperatively define a connecting through hole 116 (see FIG. 3). The front hollow cylinder 111 and the rear hollow cylinder 112 may be made from metallic material. A cable (not shown) may extend through the connecting through hole 116 and engaged in the connecting through hole 116. The cable may be fixed to an object, such as a desk.

The lid 13 is received in an opening 1122 defined in an end of the rear hollow cylinder 112 away from the front hollow cylinder 111. The lid 13 is approximately circular and defines an oblong through hole 131. Two positioning poles 132 facing each other protrude from the lid 13 away from the rear hollow cylinder 112 adjacent the oblong through hole 131.

The locking head 12 is rotatably received in the keyway 110, aligned with the oblong through hole 131, and includes a lock lever 121, a locking block 122, and an adjusting portion 123. The lock lever 121 is extended through the through hole 131. The locking block 122 and the adjusting portion 123 are fixed at two opposite ends of the lock lever 121. The adjusting portion 123 is rotatably received between the inner flange 1111 of the front hollow cylinder 111 and the inner circular stopper portion 1121 of the rear hollow cylinder 112. The adjusting portion 123 defines a number of grooves 1231. A specific key (not shown) may fit into the grooves 1231 to rotate the locking head 12. The locking block 122 is approximately oblong corresponding to the oblong through hole 131 and a longitudinal direction of the locking block 122 is approximately perpendicularly to that of the lock lever 121. The locking block 122 protrudes from the rear hollow cylinder 112 and provides two arcuate chamfers 122*a* at two opposite ends of the locking block 122 correspondingly.

Figure 6:
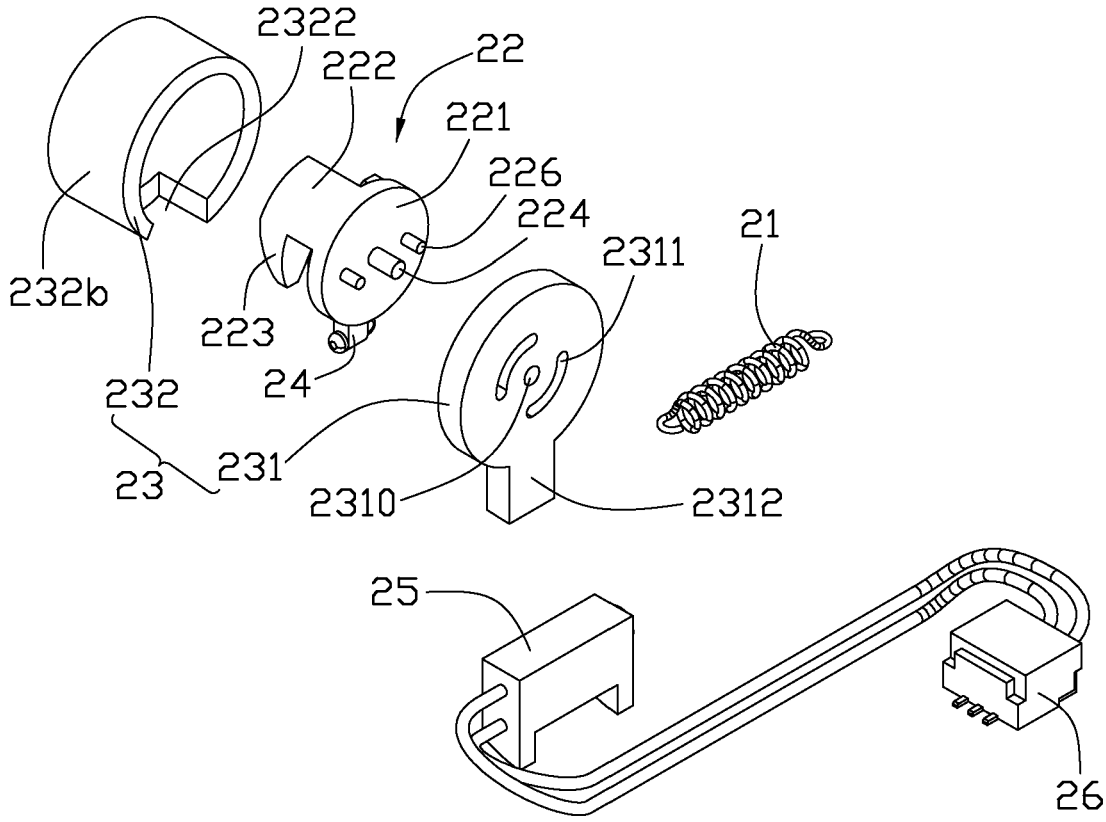
FIG. 6 is a schematic isometric disassembled view of the second lock-member of FIG. 2.
Figure 7:
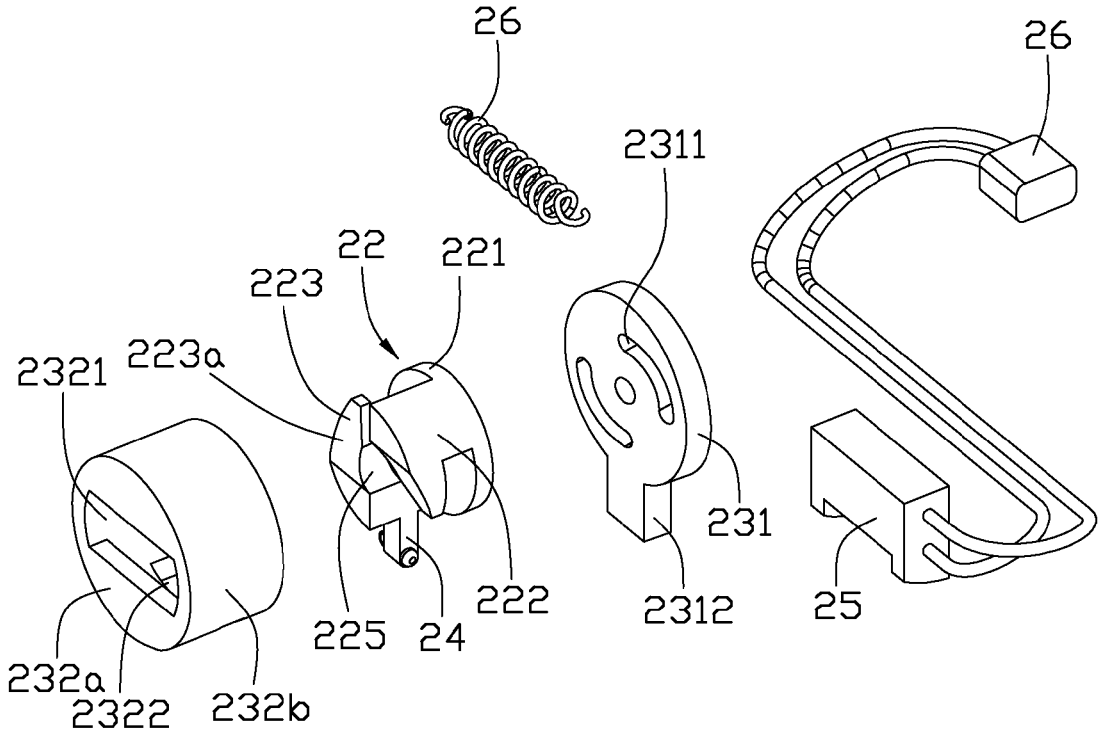
FIG. 7 is similar to FIG. 6, but viewing the second lock-member from another angle.

Referring to FIGS. 6 and 7 together with FIG. 2, the second lock-member 20 includes an elastic member 21, a lock core 22, a second cylindrical case 23, a guiding block 24, an electromagnet 25 and a controller 26. A fixing member 220 is formed on the fixed sheet 210 of the electronic device 200. In this embodiment, the elastic member 21 is a spring. In other embodiment, the elastic member 21 may be made from elastic plastic.

The second cylindrical case 23 includes a cover 232 and a bottom plate 231 fixed to the cover 232. The cover 232 includes a top plate 232*a* and an annular sidewall 232*b* extending perpendicularly from the circumferential edge of the top plate 232*a*. The top plate 232*a* defines an oblong positioning through hole 2321 aligned with the insertion through hole 212*a*. The positioning through hole 2321 is suitable for extending the locking block 122 therethrough. A longitudinal direction of the positioning through hole 2321 is approximately perpendicular to that of the through hole 131 and is parallel to that of the insertion through hole 212*a*. The sidewall 232*b* defines a cutout 2322 corresponding to the guiding block 24.

The bottom plate 231 defines a round central through hole 2310 and two curved guiding slots 2311 around the central through hole 2310. A fixing block 2312 extends from the bottom plate 231 in a direction perpendicular to an axial direction of the round central through hole 2310, and is fixed to the fixed sheet 210 of the electronic device 200.

Referring to FIGS. 6 and 7, the lock core 22 is received in the second cylindrical case 23 and includes a round plate 221, two connecting portions 222 and two engaging blocks 223. The round plate 221 is approximately parallel to the bottom plate 231 of the second cylindrical case 23. The two connecting portions 222 are spaced apart from each other and extend perpendicularly from the round plate 221 away from the bottom plate 231 and connect the two engaging blocks 223. The two engaging blocks 223 are parallel to the round plate 221. Extending directions of two distal ends of the two engaging blocks 223 are opposite to each other. Therefore, the two engaging blocks 223 cooperatively define a locking groove 225 suitable for receiving the locking block 122. Each engaging block 223 includes an inclined surface 223*a* facing the top plate 232*a*.

A rotating shaft 224 and two positioning rods 226 extend perpendicularly from the round plate 221 corresponding to the central through hole 2310 and the two guiding slots 2311. The rotating shaft 224 is rotatably extended through the central through hole 2310. The two positioning rods 226 are rotatably extended through the two guiding slots 2311 respectively.

The guiding block 24 may be integral with the lock core 22 and extends from a circumference of the round plate 221. The guiding block 24 is extended through the cutout 2322 so that the lock core 22 is rotated by rotation of the guiding block 24 around the rotating shaft 224. The guiding block 24 may be made from ferromagnetic material, such as iron, cobalt or nickel, etc. The spring 21 is fixed between the guiding block 24 and the fixing member 220 of the electronic device 200. The electromagnet 25 is positioned on the fixed sheet 210 and aligned with the guiding block 24. As such, the guiding block 24 is between the spring 21 and the electromagnet 25. The controller 26 is electrically connected to the electromagnet 25 and is configured for receiving a user input (e.g., a command or "OK" instruction) input from the electronic device 200 and controlling the electromagnet 25 in response to the user input, e.g., activating or inactivating the electromagnet 25.

Figure 8:
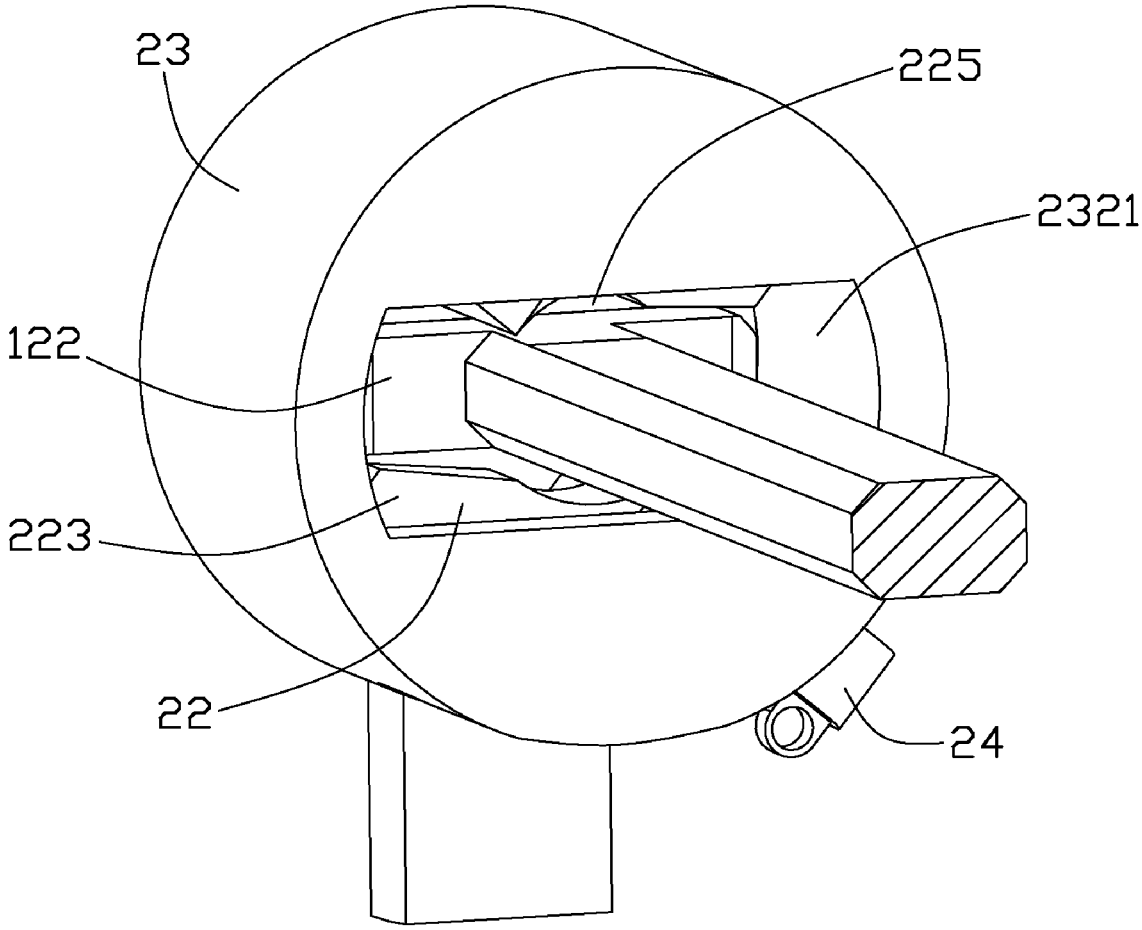
FIG. 8 is a partially schematic isometric view of the first lock-member unlocked by the second lock-member.
Figure 9:
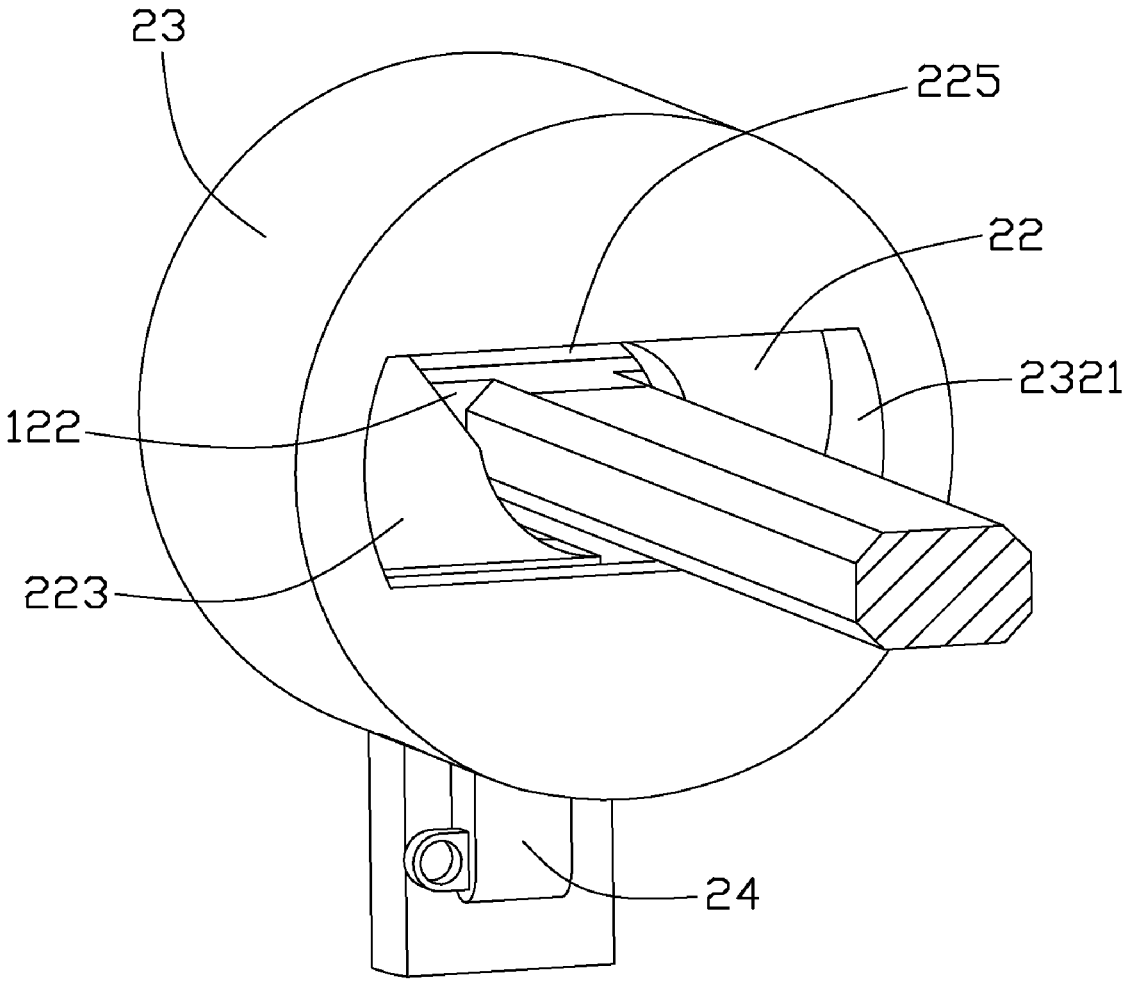
FIG. 9 is similar to FIG. 8, but showing the first lock-member locked by the second lock-member.

Referring to FIGS. 2, 6 and 8, initially, the guiding block 24 is pulled by the spring 25 towards the fixing member 220 and is restricted by the cover 232 of the second cylindrical case 23 via the cutout 2322 so that the locking groove 225 and the positioning through hole 2321 are unaligned, as shown in FIG. 9. Under this condition, the locking block 122 of the locking head 12 cannot be inserted into the lock core 22 through the insertion through hole 212*a*, the positioning through hole 2321 because the locking block 122 is blocked by the engaging blocks 223.

To lock the first lock-member 10 to the second lock-member 20 using the controller 26, the controller 26 is powered on and activates the electromagnet 25 in response to a specific user's input, e.g., a right cipher input from the electrical device 200. The electromagnet 25 generates a magnetic field to pull the guiding block 24 towards the electromagnet 25. Therefore, the lock core 22 is rotated counterclockwise in FIG. 8 around the rotating shaft 224 by the movement of the guiding block 24. Meanwhile, the spring 21 is extended because of the movement of the guiding block 24 towards the electromagnet 25. After the guiding block 24 is stopped, an longitudinal direction of the locking groove 225 is approximately parallel to and aligned with the positioning through hole 2321, as shown in FIG. 8. Upon this condition, the locking block 122 can be inserted into the lock core 22 through the insertion through hole 212*a*, the positioning through hole 2321 and the locking groove 225. Additionally, due to the existence of the two positioning rods 226, the locking block 122 can be easily inserted into the positioning through hole 2321 and the locking groove 225.

After inserting the locking block 122 into the lock core 22, the controller 26 deactivates the electromagnet 25 in response to another specific user's input, e.g., an "OK" instruction input from the electronic device 200. The magnetic field is no longer present and the guiding block 24 is pulled back by the spring 21 away from the electromagnet 25. Therefore, the lock core 22 is rotated clockwise in FIG. 9 around the rotating shaft 224 and the locking block 122 is restricted between the round plate 221 and the two engaging blocks 223 of the lock core 22 so that the first lock-member 10 is locked by the second lock-member 20, as shown in FIG. 9.

To lock the first lock-member 10 to the second lock-member 20 when the controller 26 is powered off, the first lock-member 10 may be pushed by a user towards the second lock-member 20. The locking block 122 abuts against the two inclined surfaces 223*a* of the two engaging blocks 223. As the first lock-member 10 is further pushed by the user, a torque is applied to the two engaging blocks 223 since contact between the arcuate chamfers 122*a* (see FIG. 4) of the locking block 122 and the inclined surfaces 223*a* of the two engaging blocks 223. Therefore, the lock core 22 is rotated counterclockwise in FIG. 8 by the torque until the longitudinal direction of the locking groove 225 is approximately parallel to that of the positioning through hole 2321. Meanwhile, the spring 21 is extended because of rotation of the lock core 22. Therefore, the locking block 122 can be inserted into the lock core 22 through the locking groove 225.

After the insertion of the locking block 122 into the lock core 22, the guiding block 24 is pulled back by the spring 21 away from the electromagnet 25. Therefore, the lock core 22 is rotated clockwise in FIG. 9 around the rotating shaft 224 and the locking block 122 is restricted between the round plate 221 and the two engaging blocks 223 of the lock core 22 so that the first lock-member 10 is locked by the second lock-member 20, as shown in FIG. 9.

Referring to FIGS. 4 and 9, to detach the first lock-member 10 from the second lock-member 20 using the key (not shown), the key may fit into the keyway 110 and engage with the adjusting portion 123 to rotate the locking head 12 clockwise in FIG. 9 until the locking block 122 is stopped by the connecting portions 222 of the lock core 22. The first lock-member 10 is pulled away from the lock core 22 so that the locking block 122 is received in the locking groove 225 defined by the two engaging blocks 223. The key engaging with the adjusting portion 123 rotates the locking head 12 counterclockwise around the lock lever 121. The lock core 22 is rotated counterclockwise due to the rotation of the locking block 122 and contacts between the two engaging blocks 223 and the locking block 122. The spring 21 is extended due to the rotation of the lock core 22. When a longitudinal direction of the locking block 122 is approximately parallel to that of the positioning through hole 2321, the first lock-member 10 is further pulled away from the locking core 22 and the second cylindrical case 23. Therefore, the first lock-member 10 is detached from the second lock-member 20. After this, the lock core 22 is pulled back by the extended spring 21.

In summary, the electronic device 200 can be locked by the locking assembly 100. Security for the electronic device 200 can be enhanced. Additionally, even if the controller 26 is powered off, the locking assembly 100 can use a key to lock the electronic device 200, which is convenient for the user.

It is to be understood, however, that even though numerous characteristics and advantages of the present disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A locking assembly for an electronic device, comprising:

a first lock-member comprising a rotatable locking head, the locking head comprising a lock lever, a locking block and an adjusting portion, the locking block and the adjusting portion being fixed at two opposite ends of the lock lever, the adjusting portion configured for accepting a key and rotated together with the lock lever and the locking block; and a second lock-member fixed inside the electronic device and comprising a lock core and a guiding block extending from the lock core, the lock core defining a locking groove, the guiding block being rotated together with the lock core between a first position where a longitudinal direction of the locking groove crosses that of the locking block so that the first lock-member is locked by the second lock-member and a second position where the longitudinal direction of the locking groove is approximately parallel to that of the locking block so that the first lock-member is capable of being detached from the second lock-member.

2. The locking assembly as claimed in claim 1, wherein the second lock-member further comprising an elastic member, a cylindrical case, an electromagnet and a controller, the guiding block being made from ferromagnetic material, the cylindrical case defining a positioning through hole aligned with the locking head and a cutout corresponding to the guiding block, the lock core rotatably received in the cylindrical case and comprising a round plate, two connecting portions and two engaging blocks, the two connecting portions spaced apart from each other and extending perpendicularly from the round plate towards the locking block and connecting the two engaging blocks parallel to the round plate correspondingly, extending directions of two distal ends of the two engaging blocks opposite to each other, the two engaging blocks cooperatively defining the locking groove suitable for receiving the locking block, each engaging block comprising an inclined surface towards the locking block, the guiding block extending from the round plate and extended through the cutout, the elastic member and the electromagnet positioned at two opposite sides of the guiding block, the elastic member connected to the guiding block, the controller being configured for controlling the electromagnet to generate magnetic field for pulling the guiding block rotated from the first position to the second position.

3. The locking assembly as claimed in claim 2, wherein the first lock-member further comprising a cylindrical case and a lid, the cylindrical case of the first lock-member comprising a front hollow cylinder and a rear hollow cylinder, the front hollow cylinder comprising an inner flange extending from an end of the front hollow cylinder, an inner circular stopper portion formed on an inner surface of the rear hollow cylinder, the adjusting portion rotatably received between the inner flange of the front hollow cylinder and the inner circular stopper portion of the rear hollow cylinder.

4. The locking assembly as claimed in claim 3, wherein the adjusting portion defines a plurality of grooves where the key fits into to rotate the locking head.

5. The locking assembly as claimed in claim 2, wherein the cylindrical case of the second lock-member comprises a bottom plate and a cover fixed to the bottom plate, the bottom plate defining a round central through hole and two curved guiding slots around the central through hole, a rotating shaft and two positioning rods extending perpendicularly from the round plate and rotatably extended through the central through hole and the two guiding slots respectively.

6. The locking assembly as claimed in claim 5, wherein the bottom plate further comprises a fixing block for fixing the bottom plate to the electronic device.

7. The locking assembly as claimed in claim 6, wherein the locking groove and the positioning through hole are defined oblong.

8. The locking assembly as claimed in claim 2, wherein the ferromagnetic material is selected from the group consisting of iron, cobalt, and nickel.

9. The locking assembly as claimed in claim 2, wherein the elastic member is a spring.

10. The locking assembly as claimed in claim 2, wherein the elastic member is made from elastic plastic.

11. The locking assembly as claimed in claim 1, wherein the guiding block is integral with the lock core.

12. The locking assembly as claimed in claim 1, wherein the first and second lock-members are approximately a cylinder.

* * * * *